United States Patent [19]

DeWerth et al.

[11] Patent Number: 4,768,444

[45] Date of Patent: Sep. 6, 1988

[54] COMMON VENT DEVICE FOR POSITIVE VENT PRESSURE AND DRAFT HOOD EQUIPPED GAS APPLIANCES

[75] Inventors: Douglas W. DeWerth, Cleveland; James R. Deppisch, Brookpark; Sherwood G. Talbert, Columbus; Ronald A. Cudnik, Westerville, all of Ohio

[73] Assignee: Gas Research Institute, Chicago, Ill.

[21] Appl. No.: 100,011

[22] Filed: Sep. 23, 1987

[51] Int. Cl.[4] ..... F23L 17/16

[52] U.S. Cl. ..... 110/160; 126/307 R

[58] Field of Search ..... 98/58, 60, 78; 110/160, 110/162; 126/307 R, 307 A

[56] References Cited

U.S. PATENT DOCUMENTS

| | | | |
|---|---|---|---|
| 1,869,939 | 8/1932 | Latimer | 110/160 X |
| 3,119,604 | 1/1964 | Biber et al. | 110/160 X |
| 4,187,833 | 2/1980 | Zahora et al. | 126/307 A X |
| 4,452,152 | 6/1984 | John et al. | 110/162 X |
| 4,481,935 | 11/1984 | Bawel | 126/307 R |
| 4,485,746 | 12/1984 | Erlandsson | 110/162 X |
| 4,613,297 | 9/1986 | Zanias et al. | 126/307 R X |

FOREIGN PATENT DOCUMENTS

| | | | |
|---|---|---|---|
| 1248051 | 10/1960 | France | 110/160 |

*Primary Examiner*—Harold Joyce

*Attorney, Agent, or Firm*—Pearne, Gordon, McCoy & Granger

[57] ABSTRACT

A vent device is provided for common venting of exhaust gases discharged from separate apparatus at different vent pressures. The vent device provides a passageway and exhaust gas inlets for combining the exhaust gases and conveying them to a single vent stack. The higher vent pressure exhaust gases are discharged within the passageway using a venturi or jet pump effect to provide a zone of reduced pressure in the passageway for inducing the flow of the lower vent pressure exhaust gases into the device.

24 Claims, 1 Drawing Sheet

COMMON VENT DEVICE FOR POSITIVE VENT PRESSURE AND DRAFT HOOD EQUIPPED GAS APPLIANCES

BACKGROUND OF INVENTION AND PRIOR ART

The present invention relates to the common venting of separate apparatus having exhaust gases discharged at different vent pressures.

It is accepted practice to vent several natural-draft combustion apparatus through a common vent or chimney. For example, draft hood equipped furnaces and water heaters are typically vented through a common chimney in residential applications. However, a positive vent pressure apparatus is separately vented due to the risk of flue gas spillage through the draft hood of other apparatus being vented. Thus, manufacturers of residential high-efficiency furnaces with forced-draft or fan-assisted burner systems recommend the use of a separate vent while most water heaters presently marketed use a draft hood. (The term furnace is used in a broad sense herein to include a boiler or other heating arrangement unless prohibited by the context of use. The resulting venting system is more complex, expensive and difficult to install.

When an existing natural-draft furnace is replaced with a separately vented forced-draft furnace, the chimney through which the original furnace and water heater were common vented may be oversized for the water heater alone. In such cases, the elimination of the flow of furnace draft air and exhaust gases through the chimney may result in excessive cooling and condensation of the water heater exhaust gases being vented. The chimney may not be designed to accommodate the additional condensate and venting of the gases may be impeded by the reduced buoyancy of the additionally cooled exhaust gases.

The use of fan-assisted or natural and forced-draft venting systems in a single apparatus are disclosed in U.S. Pat. Nos. 4,487,137 and 2,497,944. These systems may also include on-off fan controls responsive to flue gas temperature and adjustable damper arrangements.

The use of fans or blowers to provide venturi or jet pump flows within single apparatus vent stacks to enhance gas flow or dilute exhaust gases is disclosed in U.S. Pat. Nos. 3,585,946, 3,570,423, 3,448,917, 1,604,271 and 1,533,898. U.S. Pat. No. 2,397,870 teaches the use of a fan to provide a venturi-aspirator effect to induce atmospheric air flow into a single apparatus vent stack in order to reduce the flue gas temperature.

U.S. Pat. No. 4,149,453 discloses the addition of diluent gas with and without heating to exhaust gases in order to reduce condensation by maintaining the exhaust gases from a single apparatus above their dew point.

U.S. Pat. No. 1,869,939 discloses reducing the relative humidity and condensation of exhaust gases from a single apparatus in a fan-powered burner by injection of a flow of air from the burner fan.

SUMMARY OF INVENTION

It has been discovered that the energy of higher vent pressure exhaust gases may be used in a common vent device to induce the flow of lower vent pressure exhaust gases into the device and cause the merger of the exhaust gases to enable venting of the combined exhaust gases through a common vent stack. In accordance with the invention, the vent device is provided for common venting exhaust gases flowing from different apparatus at different vent pressures.

The vent device includes a passageway for receiving the flow of exhaust gases from a plurality of separate apparatus, merging the exhaust gases and conveying the exhaust gases to a common vent stack for atmospheric discharge. The higher vent pressure exhaust gases are discharged into the passageway to provide a zone of reduced pressure in the passageway adjacent the passageway inlet for the lower vent pressure exhaust gases. To that end, the vent device is arranged to discharge the higher vent pressure vent gases at a velocity greater than the prevailing bulk velocity of the exhaust gases within the vent device. Thus, the flow of higher vent pressure exhaust gases discharged into the device tends to accelerate surrounding exhaust gases to provide a zone of reduced pressure in the vent device.

The vent device passageway is sized to provide effective venting of single or multiple apparatus in accordance with their operating cycles. When a natural-draft apparatus is operating alone, the passageway must be of sufficient cross-sectional area to permit the unassisted flow of exhaust gases and to enable the venting due to the buoyancy of the exhaust gases. In cases where one of several natural-draft apparatus is replaced by a positive vent pressure apparatus, the vent device permits a remaining natural-draft apparatus to be common vented with the positive vent pressure apparatus and avoids the risk of inadequate venting through the original natural-draft chimney as well as potentially excessive condensation.

The vent device comprises a housing which provides the passageway for connection to a vent stack and exhaust gas inlets fixed to the housing for admitting exhaust gases into the passageway. The exhaust gas inlets are arranged for connection to the exhaust pipes of the apparatus to be vented and provide substantially unrestricted continuous flow paths for the exhaust gases.

The exhaust gas inlets may be arranged to provide a venturi-aspirator effect or a jet pump effect to provide a localized relatively higher velocity flow of gases and an adjacent zone of reduced pressure within the housing. In either case, the vent device is operated by the energy of the exhaust gases without a separate power source and it is free of moving parts. Accordingly, the device is not subject to failure due to power loss and/or mechanical wear. If a blockage of the vent stack occurs so as to cause spillage of exhaust gases through a connected apparatus, a sensor may be provided to stop operation of the exhaust gas source.

As indicated above, the vent device requires no external power source except for the gases being vented. Thus, the device has essentially no operating cost and it may be manufactured at a relatively low cost due to the simplicity of its structure.

In the illustrated embodiments, the vent device is used to vent a positive vent pressure apparatus and a non-positive vent pressure apparatus through a single vent stack. The positive vent pressure apparatus is a forced-draft or fan-assisted furnace and the non-positive vent pressure apparatus is a draft hood equipped water heater. The vent device may be used to common vent two forced-draft apparatus provided one is a non-positive vent pressure apparatus.

DETAILED DESCRIPTION OF THE DRAWINGS

Figure 1:
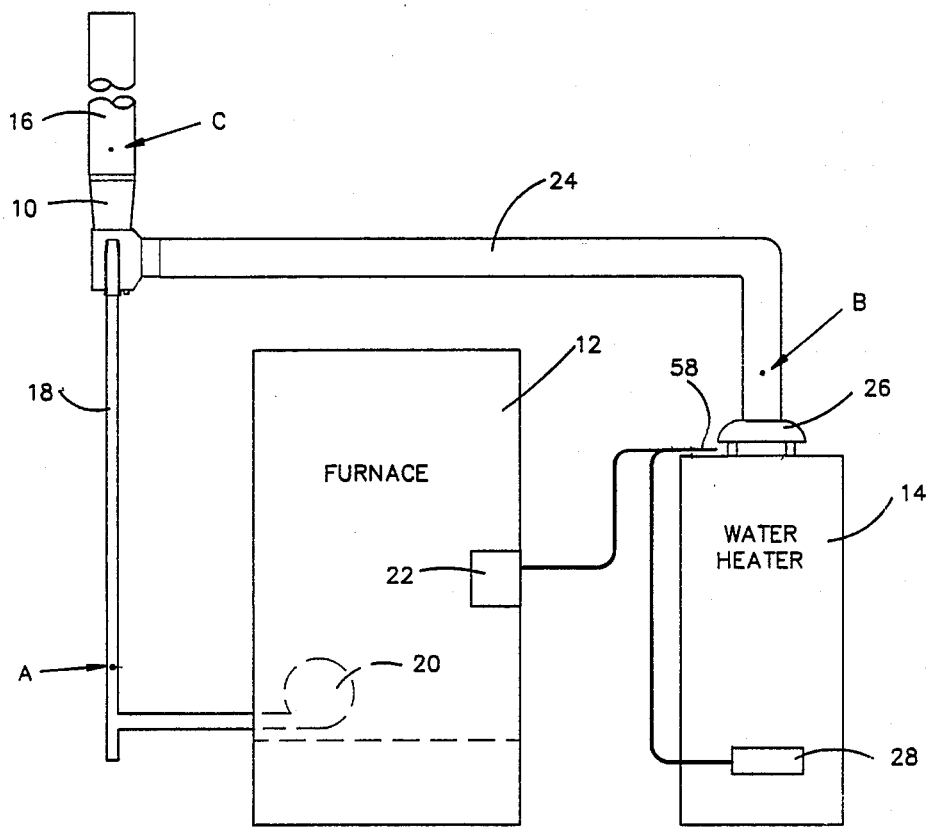
FIG. 1 is a schematic elevational view of a common vent device constructed in accordance with the invention and arranged to vent a positive vent pressure furnace and a non-positive vent pressure water heater through a single vent stack.

Referring to FIG. 1, a common vent device 10 is arranged to vent a residential high efficiency furnace 12 having a positive vent pressure and a natural-draft water heater 14 having a non-positive vent pressure through a vent stack 16 for discharge of exhaust gases to the atmosphere. The vent stack 16 is sized to provide proper venting of one or both of the furnace 12 and the water heater 14 depending upon the overlap of the operation cycles of the appliances.

The furnace 12 includes an exhaust pipe 18 connected to the vent device 10 in a fluid tight manner and a fan 20 for discharge of the furnace exhaust gases at a positive pressure through the pipe 18. The furnace 12 also includes a control enclosure 22 for mounting electrical controls to regulate the operation of the furnace in a known manner.

The water heater 14 has an exhaust pipe 24 connected between the vent device 10 and a draft hood 26 for discharge of exhaust gases from the water heater 14. The draft hood 26 is arranged to draw ambient air into the pipe 24 for dilution of the exhaust gases in a conventional manner. The water heater 14 also includes a control enclosure 28 containing controls for regulation of the operation of the water heater in a known manner.

Figure 2:
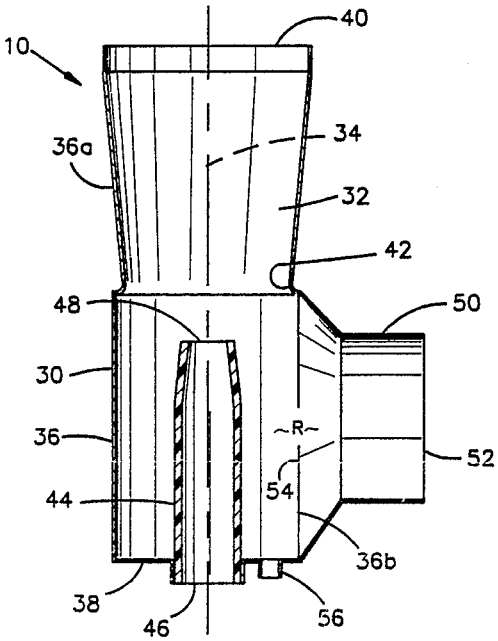
FIG. 2 is a schematic cross-sectional view on an enlarged scale of the common vent device shown in FIG. 1.

Referring to FIG. 2, the vent device 10 includes a housing 30 having a generally elongate configuration and defining a passageway 32 for conveying exhaust gases to the vent stack 16. The passageway 32 has a longitudinal axis 34 which is parallel with the direction of flow of the exhaust gases. The passageway 32 is circumferentially bounded by a sidewall 36 having a generally cylindrical shape. The housing 30 also includes an axially extending end wall 38 adjacent a proximal end of the passageway 32. The housing 30 terminates at an open end 40 adjacent the longitudinallY spaced distal end of the passageway 32. The open end 40 of the passageway 32 is adapted to be connected to the vent stack 16.

A venturi throat 42 of reduced cross-sectional area is provided at an intermediate location along the longitudinal length of the passageway 32. The adjacent downstream portion of the passageway 32 has a progressively increasing cross-sectional area provided by an outwardly flared wall portion **36*a* of the sidewall 36. The wall portion 36*a* is flared at an angle of about 2° to 7° to enhance the venturi-aspirator effect. The flared wall portion 36*a* has a longitudinal length sufficient to convert static pressure to dynamic or velocity pressure, such length being equal to about twice the maximum dimension of the venturi throat 42 herein. The localized acceleration of the exhaust gases by conversion to dynamic pressure has been found to enhance the provision of a zone of reduced pressure "R" located upstream from the venturi throat 42**.

The vent device 10 also includes a nozzle 44 for admitting exhaust gases from the furnace 12 into the housing 30 and passageway 32. The nozzle 44 has a tubular configuration and it is fixedly mounted through the end wall 38 of the housing 30.

The nozzle 44 includes an intake opening 46 adapted to be connected to the exhaust pipe 18 of the furnace 12. A nozzle outlet opening 48 is provided for discharging furnace exhaust gases into the housing 30 at a longitudinal location upstream from the venturi throat 42.

The cross-sectional area of the nozzle is substantially less than that of the passageway 32, the area ratio herein being 1:4. The nozzle 44 is also provided with a reducing taper in order to accelerate the furnace exhaust gases and enhance the venturi-aspirator effect. For example, the nozzle 44 may be provided with a generally cylindrical shape of 2" diameter and a reducing taper which results in a 1¾" diameter outlet opening 48. This taper and nozzle outlet opening accelerate the flow of exhaust gases but do not provide a substantial restriction to such flow.

The vent device 10 also includes a connector 50 for admitting exhaust gases from the water heater 14 into the housing 30. The connector 50 has an intake opening 52 adapted to be connected to the exhaust pipe 24. The connector 50 has an outwardly flared configuration adjacent its discharge end and terminates at a connector outlet opening 54 for discharging exhaust gases into the housing 30. To that end, the sidewall 36 of the housing is provided with an opening **36*b* corresponding in size with the outlet opening 54. It is not believed that the flared configuration of the connector 50 is required and, accordingly, the connector 50 may simply comprise the opening 36*b* in the wall 36 of the housing 30**.

The vent device 10 also includes a condensate drain 56 for removal of condensate collected within the housing 30. The drain 56 opens into the passageway 32, and it may be connected to a suitable hose (not shown) for discarding the condensate.

The vent device 10 may be formed of materials conventionally used to handle exhaust gases of the type being vented. For example, a device for residential applications may be made of sheet metal or a plastic material having temperature ratings in the range of 350° to 400° F.

The device 10 is sized to accommodate natural gas-fired furnaces having inputs of 60,000 to 95,000 BTU/hr. and water heaters having inputs of 30,000 to 43,000 BTU/hr. The size of the device 10 may be increased to accommodate combustion apparatus having higher heat inputs.

As shown, the nozzle 44 has a length of about 5" and a 2" diameter to correspond in size with the exhaust pipe 18. The intake opening 52 of the connector 50 has a 3" diameter to facilitate connection with the exhaust pipe 24. The open end 40 of the device 10 has a 5" diameter and corresponds in size with the vent stack 16. The venturi throat 42 has a diameter of 4" and the flared wall portion **36*a* is of sufficient longitudinal length to provide proper venturi flow. The overall length of the vent device 10 is about 15". Accordingly, the vent device 10** requires only about 1½ of clearance to enable merger of the different vent pressure exhaust gases.

The nozzle 44 is positioned so that the outlet opening 48 is located from about ½ to 2½" from the plane of the venturi throat 42. The nozzle 44 is longitudinally positioned to maximize the pressure reduction occurring in the zone of reduced pressure "R" adjacent the outlet opening 54. In the illustrated device, a sub-atmospheric or negative pressure is achieved in the zone "R" of sufficient magnitude to permit the natural-draft venting of the water heater 14 during the operation of the furnace 12.

The operation of the vent device 10 with vent stacks of different heights is reported in the following Table I. The operation of the vent device 10 characterized by static pressure, flue temperature and $CO_2$ measurements in each of the locations A, B and C as indicated in FIG. 1. The heat input to the furnace 12 was 75,000 BTU/hr and the heat input to the water heater 14 was 40,000 BTU/hr. In addition, each possible combination of operation of the appliances was tested.

As shown in Table I, negative static pressure was achieved at points B and C in all cases so as to assure proper venting of the water heater 14. The expected increases in draft with increasing stack height indicates the vent device does not interfere with conventional venting parameters. Similarly, the decrease in flue temperature with increasing stack height confirms increasing drafts. The $CO_2$ values indicate the combustion processes of the furnace and water heater are not adversely affected during simultaneous operation and the common venting of the flue gases.

The vent device 60 includes a housing 70 which provides a passageway 72 having a longitudinal axis 74. The housing 70 includes a sidewall 76 having a cylindrical shape. The sidewall 76 includes an inwardly tapered portion adjacent the proximal end of the passageway 72 which provides a connector 78 having an open end 80 adapted to be connected to the exhaust pipe 64. Alternatively, the tapered portion of the sidewall 76 may simply be replaced by an annular end wall extending at right angles to the axis 74. Adjacent the distal end of the passageway 72, the sidewall 76 extends to an open end for connection with the vent stack 66.

The housing 70 also includes a nozzle 84 mounted to the sidewall 76. The nozzle 84 includes an intake opening 86 for connection with the exhaust pipe 62 and an outlet opening 88 for discharge of exhaust gases into the passageway 72. Accordingly, the sidewall 76 is provided with an opening 90 aligned with the outlet opening 88 of the nozzle 84.

The nozzle 84 has a tubular or cylindrical configuration and a longitudinal axis 92. The nozzle 84 has sufficient length to establish flow of exhaust gases in the direction of the axis 92 for discharge into the passageway 72 intersecting the axis 74 and flow direction in the passageway at an enclosed angle $\alpha$. The angle $\alpha$ should be no greater than about 45°. In this manner, the flow of the higher vent pressure exhaust gases provides a region

TABLE I

| STACK HEIGHT | | STATIC PRESSURE(2), " W.C. | | | FLUE TEMPERATURE(2), F. | | | $CO_2$ IN FLUE GAS,(2)(3) % | | |
|---|---|---|---|---|---|---|---|---|---|---|
| FT-IN | CONDITION(1) | A | B | C | A | B | C | A | B | C |
| 2-4 | 1 | +.126 | −.008 | −.005 | 108 | — | 97 | 6.75 | — | 3.75 |
| | 2 | −.007 | −.003 | −.004 | — | 407 | 268 | — | 5.55 | 5.00 |
| | 3 | +.129 | −.010 | −.017 | 107 | 362 | 173 | 6.80 | 4.45 | 5.60 |
| 6-4 | 1 | +.135 | −.009 | −.007 | 107 | — | 97 | 6.75 | — | 3.90 |
| | 2 | −.018 | −.007 | −.015 | — | 374 | 252 | — | 4.65 | 4.00 |
| | 3 | +.129 | −.012 | −.020 | 107 | 333 | 166 | 6.80 | 3.90 | 5.30 |
| 16-4 | 1 | +.122 | −.007 | −.007 | 107 | — | 97 | 7.00 | — | 4.15 |
| | 2 | −.034 | −.013 | −.030 | — | 339 | 229 | — | 3.85 | 3.25 |
| | 3 | +.115 | −.012 | −.019 | 108 | 315 | 164 | 7.20 | 3.60 | 5.35 |

NOTES:
(1)WHERE:
1 FURNACE OPERATING ALONE
2 WATER HEATER OPERATING ALONE
3 BOTH APPLIANCES OPERATING
(2)MEASUREMENT LOCATIONS A, B AND C REFER TO FIG. 1
(3)ALL CO VALUES WERE ≦ .004% ON AN AIR-FREE BASIS

The controls for the furnace 12 include a temperature responsive switch arranged to interrupt the operation of the furnace if the vent stack 16 becomes blocked so as to cause spillage of flue gases through the draft hood 26. To that end, a thermocouple lead 58 is arranged to sense the temperature at an air intake location of the draft hood 26 and to provide an appropriate signal to the furnace controls. In a like manner, the signal may also be provided to a similar temperature responsive switch arranged to interrupt the operation of the water heater 14.

Figure 3:
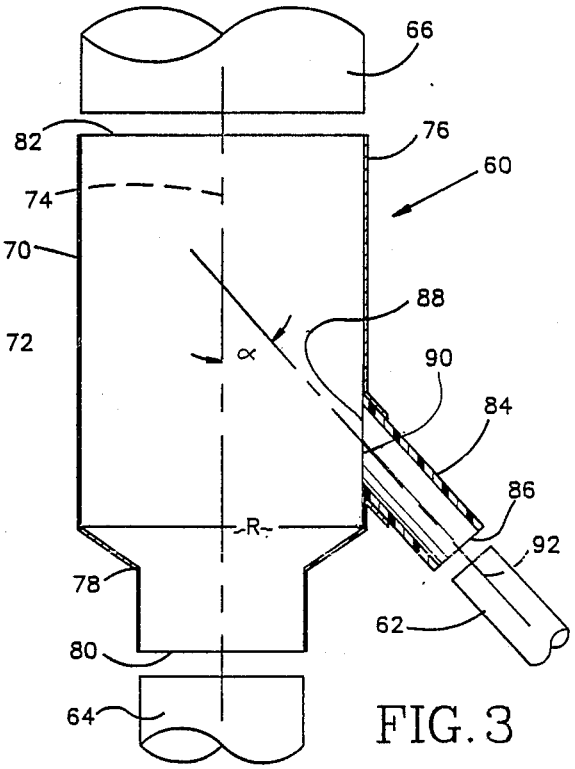
FIG. 3 is a schematic view similar to FIG. 2 of another embodiment of the common vent device in accordance with the invention.

Referring to FIG. 3, a common vent device 60 is shown. The vent device 60 operates using a jet pump principle for causing velocity pressure to induce the flow of exhaust gases. The vent device 60 is particularly useful in connection with higher pressure systems, for example, in the range of 15 to 20 psig and higher.

As shown in FIG. 3, the vent device 60 is arranged for connection with an exhaust pipe 62 of a positive vent pressure apparatus and an exhaust pipe 64 of a non-positive vent pressure apparatus. The exhaust gases are conveyed by the device 60 to a vent stack 66.

of reduced pressure "R" for inducing the flow of exhaust gases into the passageway from the lower vent pressure exhaust pipe 64.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A vent device for common venting a first apparatus having an exhaust pipe for discharge of exhaust gases at a first vent pressure and a second apparatus having an exhaust pipe for discharge of exhaust gases at a second vent pressure which is lower than said first vent pressure comprising housing means including a passageway having a cross-sectional area for flow of exhaust gases admitted into said housing means to a common vent stack, first inlet means adapted to be connected in fluid tight communication with said first exhaust pipe for admitting exhaust gases from said first apparatus to said housing means and second inlet means adapted to be connected in fluid tight communication with said second exhaust pipe for admitting exhaust gases from said second apparatus into said housing means, said first inlet means including a first outlet opening having a cross-sectional area substantially less than that of said passageway for discharging exhaust gases from said first apparatus at substantially said first vent pressure into said housing means, said second inlet means including a second outlet opening for discharging exhaust gases from said second apparatus at substantially said second vent pressure into said housing means, said first inlet means and housing means cooperating upon discharge of exhaust gases through said first outlet opening to provide a zone of reduced pressure adjacent said second outlet opening within said housing means to induce exhaust gas flow into said housing means from said second apparatus.

2. A vent device according to claim 1, wherein said first and second inlet means permit substantially unrestricted flow of exhaust gases from said exhaust pipes into said housing means.

3. A vent device according to claim 1, wherein said vent device operates solely by exhaust gases discharged from said exhaust pipes.

4. A vent device according to claim 1, wherein said first inlet means cooperates with said housing means to provide a localized relatively higher velocity flow of gases adjacent said zone of reduced pressure within said housing means.

5. A vent device according to claim 4, wherein said zone of reduced pressure is sub-atmospheric.

6. A vent device according to claim 5, wherein said housing means includes condensate means for collecting condensate from said exhaust gases and draining the collected condensate.

7. A vent device according to claim 6, wherein said passageway has a longitudinal axis extending in the direction of flow of said exhaust gases, said first outlet opening is arranged to discharge said exhaust gases into said passageway in a direction parallel with said longitudinal axis and said second outlet opening is arranged to discharge exhaust gases into said passageway at a location upstream from said first outlet opening and in a direction intersecting said longitudinal axis.

8. A vent device according to claim 7, wherein said housing means includes a circumferential wall extending about said longitudinal axis to provide said passageway, said passageway having a proximal end and a longitudinally spaced distal end, said housing means also including an axial extending end wall adjacent said proximal end ot said passageway, said distal end of said passageway being open and adapted to be connected to said common vent stack.

9. A vent device according to claim 8, wherein said first inlet means includes a nozzle member having a discharge end which provides said first outlet opening and an intake end having an intake opening adapted to be connected to said first exhaust pipe, said nozzle member being mounted to said housing means and extending through said end wall.

10. A vent device according to claim 9, wherein said second inlet means includes a connector member having a discharge end providing said second outlet opening and an intake end having an intake opening adapted to be connected to said second exhaust pipe.

11. A vent device according to claim 10, wherein said circumferential wall has a transverse opening extending therethrough and said connector member is mounted to said circumferential wall to provide said second outlet opening in the plane of said transverse opening.

12. A vent device according to claim 11, wherein said discharge end of said connector member has a cross-sectional area greater than that of said intake opening of the connector member.

13. A vent device according to claim 12, wherein said passageway includes a longitudinal portion having a progressively increasing cross-sectional area in the direction of flow of said exhaust gases.

14. A vent device according to claim 13, wherein said passageway includes a venturi throat of reduced cross-sectional area at a downstream location from said first outlet opening.

15. A vent device according to claim 4, wherein said passageway has a longitudinal axis extending in the direction of flow of said exhaust gases, said first outlet opening is arranged to discharge exhaust gases into said passageway in a direction intersecting said longitudinal axis, and said second outlet opening is arranged to discharge exhaust gases into said passageway at a location upstream from said first outlet opening and in a direction parallel with said longitudinal axis

16. A vent device according to claim 15, wherein said housing means includes a circumferential wall extending about said longitudinal axis to provide said passageway, said passageway having proximal and distal longitudinally spaced open axial ends, said second inlet means including connector means for connecting said proximal open end of said passageway to said second exhaust pipe, said distal open end of said passageway being adapted to be connected to said vent stack, and said first inlet means including a nozzle member mounted to said housing means to discharge exhaust gases within said housing means in a direction intersecting said longitudinal axis at an angle no greater than about 45°.

17. A vent device according to claim 16, wherein said first inlet means includes a nozzle member having a discharge end which provides said first outlet opening and an intake end adapted to be connected to said first exhaust pipe, said nozzle member being mounted to said housing means and extending through said circumferential wall.

18. A vent device for common venting a furnace having a positive vent pressure and a water heater having a non-positive vent pressure and a draft hood comprising housing means providing a fluid tight passageway for conveying exhaust gases from said furnace and water heater to a vent stack, said passageway having a cross-sectional area sufficient to enable venting of said water heater by natural-draft, first and second exhaust gas inlet means for admitting exhaust gases respectively from said furnace and water heater into said passageway, said first inlet means including a first outlet opening for discharging exhaust gases from said furnace into said passageway, said first outlet opening having a cross-sectional area substantially smaller than that of said passageway, said second inlet means including a second outlet opening for discharging exhaust gases from said water heater into said passageway, said first inlet means and housing means cooperating upon discharge of said furnace exhaust gases at a positive pressure into said passageway to aspirate gas flow into the passageway through said second outlet opening and draft hood.

19. A vent device according to claim 18, wherein said passageway includes a venturi throat of reduced cross-sectional area at a location downstream from said first outlet opening and an adjacent downstream portion having a progressively increasing cross-sectional area.

20. A vent device according to claim 19, wherein said first inlet means includes a tubular nozzle member having a discharge end providing said first outlet opening adjacent said venturi throat and an intake end adapted to be connected to said furnace exhaust pipe, said nozzle member being fixedly mounted to said housing means.

21. A vent device according to claim 20, wherein said first outlet opening has an area equal to about $\frac{1}{4}$ of the area of said venturi throat.

22. A vent device according to claim 21, wherein said portion of said passageway of increasing cross-sectional area has an axial length equal to about twice the major dimension of said venturi throat.

23. A vent device according to claim 22, wherein said second inlet means includes a portion having an enlarged cross-sectional area adjacent said second outlet opening.

24. A vent device according to claim 18, including a sensor means for determining the spillage of exhaust gases through said draft hood and interrupting the operation of said furnace.

* * * * *